US006637116B1

(12) United States Patent
Hill

(10) Patent No.: US 6,637,116 B1
(45) Date of Patent: Oct. 28, 2003

(54) DECORATIVE FRUIT CUTTING APPARATUS

(76) Inventor: Jewel D. Hill, 2272 Florin Rd., Sacramento, CA (US) 95822

( * ) Notice: Subject to any disclaimer, the term of this patent is extended or adjusted under 35 U.S.C. 154(b) by 46 days.

(21) Appl. No.: 10/108,035

(22) Filed: Mar. 26, 2002

Related U.S. Application Data

(63) Continuation-in-part of application No. 09/567,919, filed on May 10, 2000, now abandoned.

(51) Int. Cl.[7] ..... B26B 13/00

(52) U.S. Cl. ..... 30/253; 30/230; 30/114; 30/355

(58) Field of Search ..... 30/253, 229, 230, 30/355, 114, 366, 124; 99/537

(56) References Cited

U.S. PATENT DOCUMENTS 221,622 A * 11/1879 Sly
595,289 A * 12/1897 Devaun
609,364 A * 8/1898 Olmsted ..... 30/230
909,145 A * 1/1909 Brunson
1,482,736 A * 2/1924 Catsules
2,326,178 A * 8/1943 Seeberger ..... 30/230
2,675,843 A * 4/1954 Jarvis
2,916,822 A * 12/1959 Weidauer et al. ..... 30/230
4,930,219 A * 6/1990 Nadeau ..... 30/230

* cited by examiner

*Primary Examiner*—Douglas D. Watts

(57) ABSTRACT

A decorative fruit cutting apparatus is provided formed from two semicircular sections and having an inner diameter the size of the fruit or vegetable to be cut up. A plurality of evenly spaced cutting blades line the periphery of the inner diameter of the assembled ring. The two ring sections are pivotally attached together at one end so that the two ring sections can freely expand and contract around the fruit or vegetable.

2 Claims, 3 Drawing Sheets

DECORATIVE FRUIT CUTTING APPARATUS

RELATED APPLICATIONS

The present invention is a Continuation in Part of U.S. application, Ser. No. 09/567,919 filed on May 10, 2000 now abandoned.

BACKGROUND OF THE INVENTION

1. Field of the Invention

The present invention relates generally to devices for slicing and cutting fruits and vegetables and, more particularly, to a fruit or vegetable slicer which slices the fruit or vegetable into two semi-hemispherical sections.

2. Description of the Related Art

Cooks, chefs and others who prepare food are familiar with the time and effort it takes to prepare cut designs in fruits and vegetables. While the final outcome is not only appealing to look at, it is also very healthy as well. Melons, tomatoes, potatoes, and the like can be transformed from simple foods to works of art simply by the adding of cut patterns to their outer surface. Large fruits such as melons can be made into dainty bite-sized pieces as well in a uniform manner and mixed with other fruits cut identically, but of a different color to produce a fruit salad with practically all of the colors of the rainbow. However, all of this preparation takes time, not only for the professional, but those who prepare meals at home as well.

A search of the prior art did not disclose any patents that read directly on the claims of the instant invention; however, the following references were considered related.

The following patents disclose a cutter blade for producing helical vegetable strips:

U.S. Pat. No. 5,992,287 issued in the name of Dube;

U.S. Pat. No. 5,211,098 issued in the name of Mendenhall; and

U.S. Pat. No. 5,097,735 issued in the name of Mendenhall.

The following patents describe the design and function of a pumpkin carving knife:

U.S. Pat. No. 5,687,484 issued in the name of Hahn; and

U.S. Pat. No. D 268,639 issued in the name of Johannsen.

U.S. Pat. No. 5,558,011 issued in the name of Heim discloses a fruit paring and cutting apparatus.

U.S. Pat. No. 5,081,770 issued in the name of Fierthaler describes a tomato knife.

U.S. Pat. No. 5,075,973* issued in the name of Borner discloses a device for cutting fruit, vegetables, or the like into slices.

U.S. Pat. No. 4,083,107 issued in the name of Kuka describes a citrus peeling knife.

And, U.S. Pat. No. 4,058,892 issued in the name of Adamko discloses a tool decorating instrument for cutting fruit into a pre-determined pattern.

Consequently, there exists a need for a means by which elaborate designs and patterns can be cut into fruits and vegetables in a simple, but quick and easy manner.

SUMMARY OF THE INVENTION

Therefore, it is an object of the invention to provide for ornamentally preparing fruit or vegetable slices with a unique pattern.

Briefly described according to one embodiment of the present invention, a decorative fruit cutting apparatus is disclosed consisting of a flat ring formed from two semi-circular sections and having an inner diameter the size of the fruit or vegetable to be cut up. A plurality of evenly spaced cutting blades line the periphery of the inner diameter of the assembled ring. The slicer would be manufactured in several different versions having differing shaped teeth for ornamental effect. The two ring sections are pivotally attached together at one end so that the two ring sections can freely expand and contract around the fruit or vegetable.

When contracted around a fruit or vegetable, the blades penetrate the skin and sever the fruit or vegetable in half.

An advantage of the present invention is that it provides for ornamentally preparing fruit or vegetable slices with a unique pattern.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
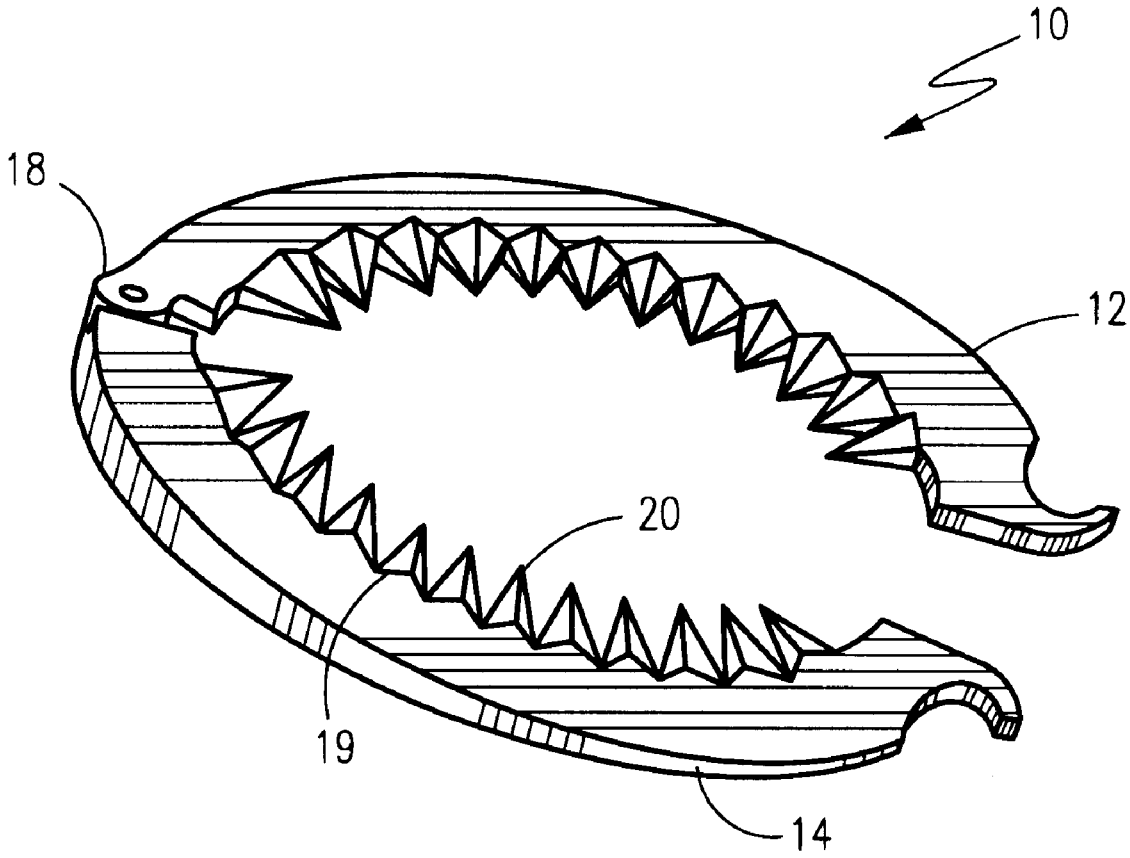
FIG. 1 is a perspective view of a decorative fruit slicing apparatus according to the preferred embodiment of the present invention.

Referring now to FIG. 1 a decorative fruit slicing apparatus 10 is shown, according to the present invention. The apparatus overall forms a flat ring formed from two semi-circular sections, a first curved blade 12 and a second curved blade 14. The first curved blade 12 has an arched back 16 forming the rearmost portion of the ring. At one end of the back 16 is affixed a first handle 17*a*; at the other end of the back 16 is a hinge 18, as will be discussed in greater detail below. The second curved blade 14 also has an arched back 16 forming the rearmost portion of the ring. At one end of the back 16 is affixed a first handle 17*b*; at the other end of the back 16 is the hinge 18.

The hinge 18 pivotally affixes the first curved blade 12 to the second curved blade 14 along one end; the handles 17*a*, 17*b* are positioned opposite the hinge 18. The two ring sections are pivotally attached together, each flat lower surface 22 mating to the other respectively, at one end so that the two ring sections can freely expand and contract around the fruit or vegetable.

The inner arc of each blade 12, 14 forms a spine 19. A plurality of evenly spaced cutting detente 20 line the inner periphery of the spine 19.

Although not necessary for operation of the present invention, in its best mode it is envisioned that the first curved blade 12 would be identical to the second curved blade 14.

Figure 2:
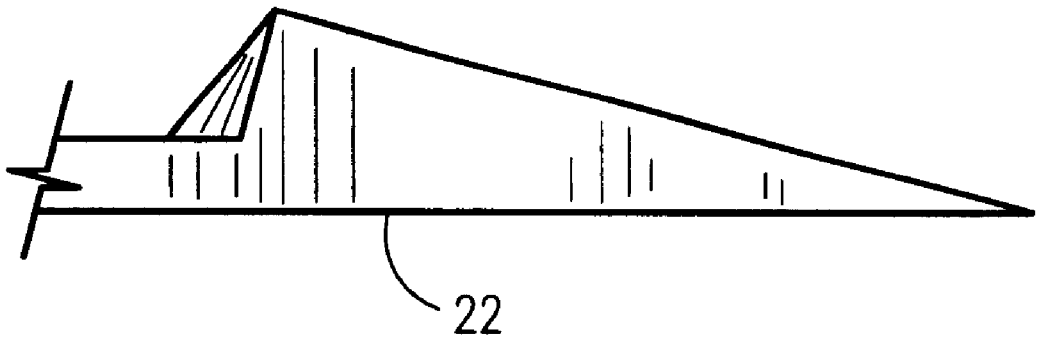
FIG. 2 is a side elevational view of a cutting detente 20 for sue with the preferred embodiment of the present invention.
Figure 3:
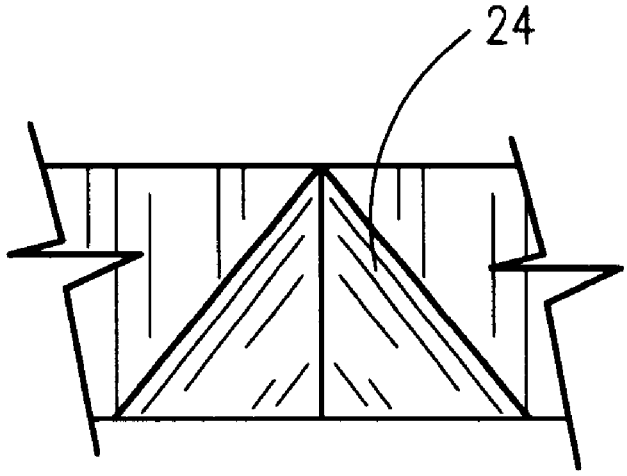
FIG. 3 is a front plan view of a cutting detente 20 for use with the preferred embodiment of the present invention.
Figure 4:
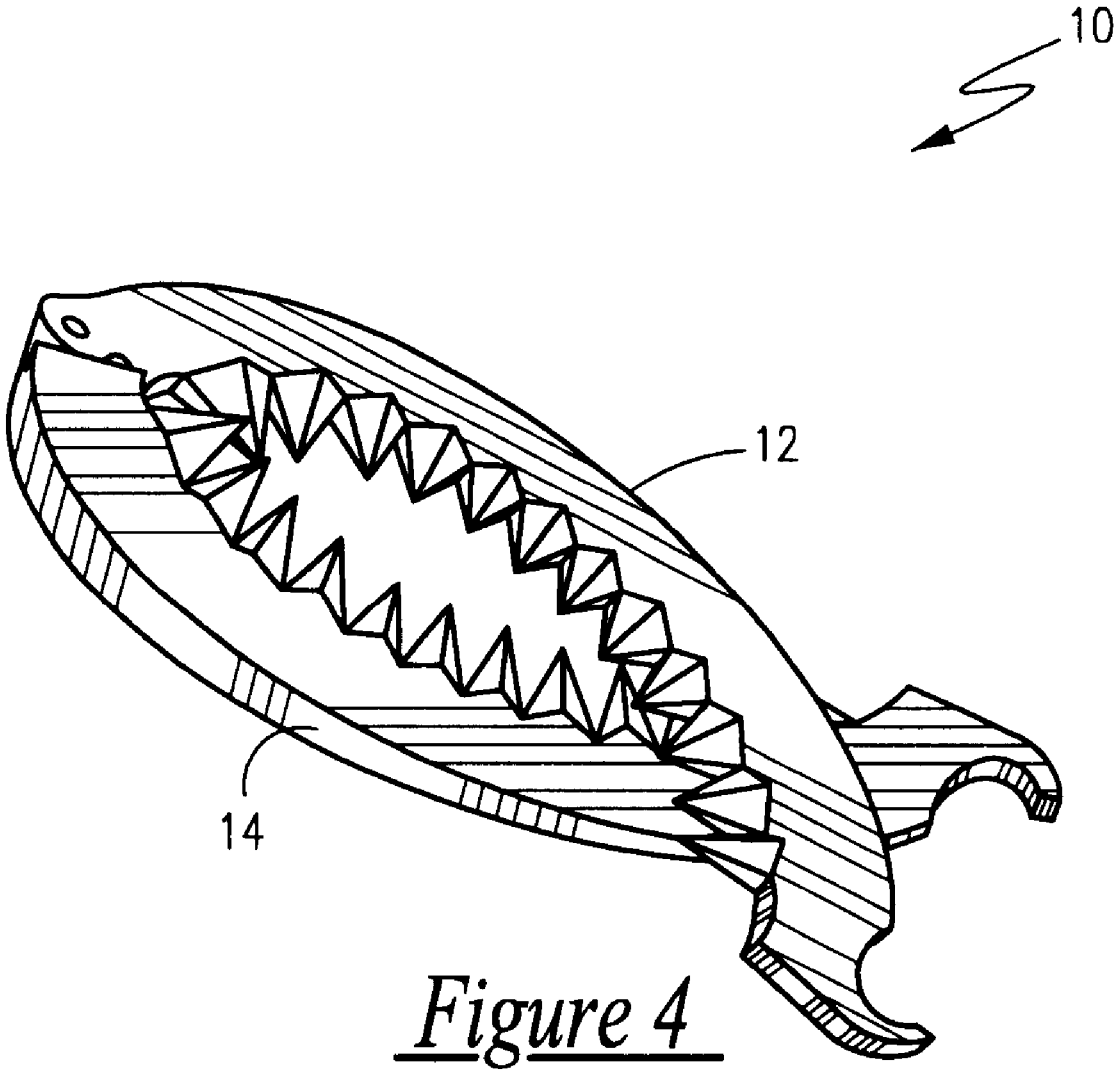
FIG. 4 is a perspective view of a decorative fruit slicing apparatus of FIG. 1 show in a closed position

Referring now to FIG. 2 and FIG. 3, each detente 20 is envisioned has having a flat lower surface 22 and a faceted upper surface 24. When the two 40 blades 12, 14 are pivotally attached together, the flat lower surface 22 located on the first curved blade 12 slides smoothly past the faceted upper surface 24 located on the second curved blade 14. Envisioned as being pyramidal in shape, the faceted upper surface 24 would be bounded at its free end by a first cutting edge 26 intersecting with a second cutting edge 28 opposite the detente 20 attachment to the spine 19. It is envisioned that by changing the faceted upper surface 24 in shape and geometry, several different versions can be implemented for accomplishing different ornamental effects.

2. Operation of the Preferred Embodiment

To use the present invention, the user merely pivots each blade 12, 14 about the hinge 18 until the first blade 12 is separated from the second blade 14, creating an open condition. Next, a piece of fruit, vegetable, foodstuff or the like is inserted there between. By grasping the handles and pulling together such that the cutting detente 20 penetrate the cut item, the faceted upper surface 24 creates a serrated, decorative peripheral edge along the cut boundary.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A decorative fruit slicing apparatus comprising:

a first curved blade having an arched back forming the rearmost portion of the blade and an inner arc forming a spine, said first blade having plurality of evenly spaced cutting detente lining the entire inner periphery of said spine;

a second curved blade having an arched back forming the rearmost portion of the blade and an inner arc forming a spine, said second blade having plurality of evenly spaced cutting detente lining the entire inner periphery of said spine; and a hinge pivotally affixing said first curved blade to said second curved blade;

wherein each said cutting detente comprises a flat lower surface and a faceted upper surface; and wherein each faceted upper surface is be bounded at its free end by a first cutting edge intersecting with a second cutting edge opposite the detente attachment to the spine and above a flat lower surface, whereby when said two blades are pivotally attached together, said flat lower surface located on said first curved blade slides smoothly past the faceted upper surface located on said second curved blade so that the two ring sections can freely expand and contract relative to each other.

2. The decorative fruit slicing apparatus of claim 1, wherein said first curved blade is identical to said second curved blade.

* * * * *